US007708429B2

(12) United States Patent
Kennedy et al.

(10) Patent No.: US 7,708,429 B2
(45) Date of Patent: May 4, 2010

(54) ILLUMINATED DOCUMENT DISPLAY SYSTEM

(76) Inventors: Gregory Kennedy, 3210 George White Rd., Moab, UT (US) 84532; Douglas Kennedy, 3525 Lemon La., Moab, UT (US) 84532

( * ) Notice: Subject to any disclaimer, the term of this patent is extended or adjusted under 35 U.S.C. 154(b) by 956 days.

(21) Appl. No.: 11/459,080

(22) Filed: Jul. 21, 2006

(65) Prior Publication Data

US 2008/0018960 A1 Jan. 24, 2008

(51) Int. Cl.
*F21V 33/00* (2006.01)

(52) U.S. Cl. ..... 362/253; 362/84; 362/98; 362/154; 40/611.1

(58) Field of Classification Search ..... 362/253, 362/154, 84, 98, 99; 40/611.01, 611.06, 40/611.1, 559

See application file for complete search history.

(56) References Cited

U.S. PATENT DOCUMENTS

| | | | | |
|---|---|---|---|---|
| 3,885,145 | A * | 5/1975 | Wise | 362/99 |
| 4,157,626 | A | 6/1979 | Bedinghaus | |
| 4,715,499 | A | 12/1987 | Franklin | |
| 4,880,315 | A | 11/1989 | Berry et al. | |
| 4,884,360 | A | 12/1989 | Pearcy | |
| D310,576 | S | 9/1990 | Narbut et al. | |
| 5,002,401 | A | 3/1991 | Blackman | |
| 5,359,797 | A | 11/1994 | Williamson | |
| 5,390,957 | A * | 2/1995 | Metzler | 280/819 |
| 5,607,225 | A * | 3/1997 | Halvatzis | 362/125 |
| 6,065,659 | A | 5/2000 | Fax | |
| 6,230,952 | B1 | 5/2001 | Jupiter | |
| 6,431,724 | B1 | 8/2002 | Tedham et al. | |
| 6,851,822 | B2 * | 2/2005 | Herrera | 362/99 |
| 6,908,206 | B1 | 6/2005 | Pinciaro | |
| 2005/0252799 | A1 * | 11/2005 | Wang | 206/311 |
| 2006/0092622 | A1 * | 5/2006 | Tam | 362/99 |

FOREIGN PATENT DOCUMENTS

| | | | |
|---|---|---|---|
| EP | 100364 | B1 | 7/1983 |
| WO | WO2004038282 | A3 | 5/2004 |
| WO | WO2009090881 | A1 | 7/2009 |

* cited by examiner

*Primary Examiner*—Laura Tso
(74) *Attorney, Agent, or Firm*—Trent H. Baker; Baker & Associates PLLC

(57) ABSTRACT

The present invention relates to an illuminated document display system. One embodiment of the present invention relates to a portable document display case configured to house at least one document for discrete illuminated visual viewing. The display case further includes an illumination system, a document protection system, and a storage system. The illumination system is configured to house an illumination device in a manner that facilitates visually receiving information from a document while minimizing external non-document light transmission. The document protection system provides a receptacle to protectively house a document while maintaining the ability for a user to view the document. In addition, the document protection system is configured to enable the illumination system to transmit light upon the document. The storage system enables the illumination system and document display system to be manipulated in a manner to provide for convenient storage without damaging the document. A second embodiment of the present invention relates to a method for illuminating a document in a manner to receive visual information from the document while minimizing non-document light transmission.

19 Claims, 3 Drawing Sheets

ILLUMINATED DOCUMENT DISPLAY SYSTEM

FIELD OF THE INVENTION

The invention generally relates to document display cases. In particular, the present invention relates to an illuminated document display system.

BACKGROUND OF THE INVENTION

Documents convey graphical and textual information that may be necessary to make a determination about how to act or react in a particular situation. These documents include maps, charts, lists, codes, etc. For example, a foreign individual may repeatedly use a graphical map of a new city to navigate to a desired location.

Unfortunately, documents printed on conventional paper materials are vulnerable to damage from heat, water, chemicals, radiation, and other materials. Therefore, users often house particular documents in cases or sleeves for protective viewing. Preferable existing document case and sleeve technologies protect documents and maintain the ability to view their contents while housed within the particular case or sleeve. These technologies often utilize transparent materials for viewing while protecting the document from external elements. Unfortunately, many of these technologies impede a user's ability to view portions of a document or effectively store the document during periods of non-use.

Many documents are utilized intermittently and therefore must be capable of convenient concealment or storage while not in use. Paper based documents are conventionally stored by folding or otherwise minimizing their dimensions. Unfortunately, the process of repeatedly folding a paper document causes damage and eventually renders the document unusable. Therefore, a system of effective document concealment and storage must also maintain protection of the document so as not damage the document during repeated processes of concealment and subsequent exposure for utilization. Almost all existing document protection systems fail to provide a convenient means for concealment when the document is not in use. Likewise, almost all existing systems of document storage and concealment fail to provide sufficient protection from damage as a result of repeated storage.

In order to receive information from a printed document, a user must have the ability to view the document. At night and in certain optically constrained regions, a user may not have sufficient sunlight to view a document unassisted. As a result, users may carry an illumination system for viewing a document and physically navigating during the night or in an optically contained region. However, it is cumbersome to independently support, orient, and operate both a document and an illumination system to allow for effective visual inspection of a document. In addition, certain circumstances may require a user to avoid non-essential optical illumination for purposes of maintaining concealment or so as not to attract attention. For example, covert military operations often require personnel to minimize damages by attempting to maintain concealment during execution. However, even in these circumstances individuals must receive visual information from particular documents.

Therefore, there is a need in the industry for a document display system that overcomes the problems discussed above.

SUMMARY OF THE INVENTION

The present invention relates to an illuminated document display system. One embodiment of the present invention relates to a portable document display case configured to house at least one document for discrete illuminated visual viewing. The display case further includes an illumination system, a document protection system, and a storage system. The illumination system is configured to house an illumination device in a manner that facilitates visually receiving information from a document while minimizing external non-document light transmission. The document protection system provides a receptacle to protectively house a document while maintaining the ability for a user to view the document. In addition, the document protection system is configured to enable the illumination system to transmit light upon the document. The storage system enables the illumination system and document display system to be manipulated in a manner to provide for convenient storage without damaging the document. A second embodiment of the present invention relates to a method for illuminating a document in a manner to receive visual information from the document while minimizing non-document light transmission. A third embodiment of the present invention relates to a method for storing an illuminated document display system by minimizing the dimensional characteristics of the illuminated document display system.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention relates to an illuminated document display system. One embodiment of the present invention relates to a portable document display case configured to house at least one document for discrete illuminated visual viewing. The display case further includes an illumination system, a document protection system, and a storage system. The illumination system is configured to house an illumination device in a manner that facilitates visually receiving information from a document while minimizing external non-document light transmission. The document protection system provides a receptacle to protectively house a document while maintaining the ability for a user to view the document. In addition, the document protection system is configured to enable the illumination system to transmit light upon the document. The storage system enables the illumination system and document display system to be manipulated in a manner to provide for convenient storage without damaging the document. A second embodiment of the present invention relates to a method for illuminating a document in a manner to receive visual information from the document while minimizing non-document light transmission. A third embodiment of the present invention relates to a method for storing an illuminated document display system by minimizing the dimensional characteristics of the illuminated document display system. While embodiments of the present invention are directed at illuminated document display systems, it will be appreciated that the teachings of the present invention may also be applicable to other areas.

The following terms are defined as follows:

Illumination device—a device configured to generate illumination in a particular optical pattern.

Electrical illumination system—an electrically powered system configured to generate visible or non-visible illumination of a particular optical pattern. For example, a conventional bulb or LED flashlight.

Chemical illumination system—a chemically powered system configured to generate visible or non-visible illumination in a particular optical pattern. For example, a CYALUME™, KRILL™ Light, or CHEMSTICK™.

Figure 1:
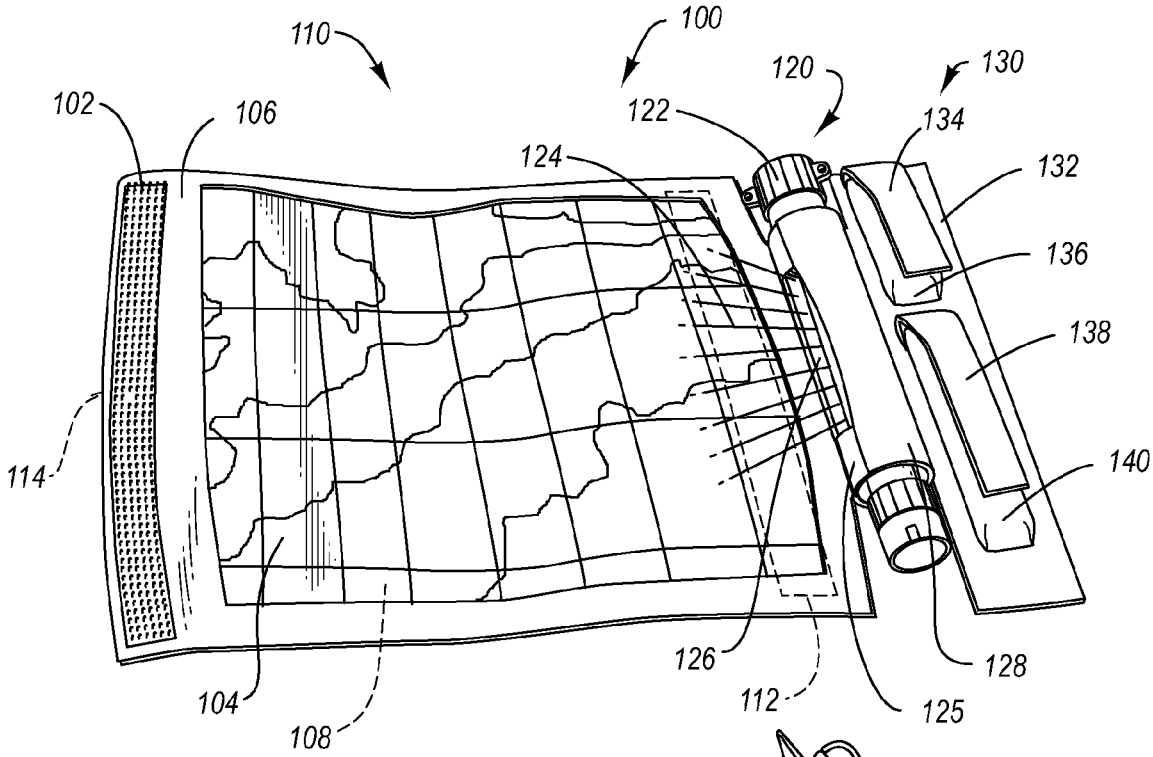
FIG. 1 illustrates a perspective view of a illuminated document case in accordance with one embodiment of the present invention.

Reference is initially made to FIG. 1, which illustrates a perspective view of an illuminated document case in accordance with one embodiment of the present invention, designated generally at 100. The illuminated document case 100 further includes a sleeve 110, a receptacle 120, and a storage flap 130. The sleeve 110, receptacle 120, and storage flap 130 are flexibly coupled to one another to facilitate rotational articulation along the illustrated vertical axis. The sleeve 110 further includes a transparent member 104, a housing 106, a document 108, a pair of releasable coupling members 102 and 112, and a resealable opening 114. The document 108 is disposed within a hollow internal region of the sleeve 110 such that it is housed within the housing 106 and can substantially be viewed through the transparent member 104 as illustrated. The transparent member 108 is coupled to the housing 106 to enclose the hollow internal region. The transparent member 108 may be composed of any flexible transparent material including but not limited to plastic composites. Likewise, the housing 106 may be composed of any flexible durable material such as CORDURA™, canvas, or some combination thereof. The resealable opening 114 is positioned on an end of the sleeve 102 opposite the receptacle 120. The resealable opening 114 allows the document 108 or some other item to be inserted and/or removed from the internal hollow region. The resealable opening 114 may include some form of resealing system such as VELCRO™ or a zipper. The pair of releasable coupling members 102 and 112 are configured to facilitate releasably securing the illuminated document case 100 in a dimensionally minimized configuration as will be illustrated and described in further detail with reference to FIGS. 5A-5D.

The receptacle 120 is flexibly coupled to one of the ends of the sleeve 110 as illustrated. The receptacle 120 is configured to enable an illumination source to discretely illuminate a portion of the sleeve 110. The receptacle includes an illumination device 122, a light transmission 124, a pair of expandable members 125, an illumination opening 126, and support cover 128. The illumination device 122 is configured to generate illumination using any system including but not limited to electrical and chemical. Various shapes, sizes and illumination systems may be utilized in accordance with the present invention. The illumination device 122 is inserted lengthwise into the receptable as shown and described with reference to FIGS. 4A and 4B. The light transmission 124 is a representation of the optionally engaged light transmission from the illumination device. For example, if the illumination device is electrical, and turned on, the light transmission 124 is configured to transmit through the illumination opening 126 as illustrated. The pair of expandable members 125 are optionally coupled to the receptacle to partially obstruct/direct a portion of the light transmission 124 onto the sleeve 110 and to facilitate releasably engaging the illumination device 122 within the receptacle 120. Likewise, the support cover 128 is shaped and disposed to selectively support the illumination device 122 in the receptacle while obstructing/directing the light transmission 124 onto the sleeve as illustrated. Various shapes and configurations of covers and openings may be utilized in accordance with the present invention for supporting an illumination device and directing light transmission onto the sleeve.

The storage flap 130 is an optional component of the illuminated document case 100 which may be flexibly coupled to the receptacle 120 on the opposite side of the sleeve 110, as illustrated. The storage flap 130 may be utilized to store items relevant to the document 108, the illumination device 122, or any other supply. For example, the storage flap 130 may house additional illumination devices, bulbs, batteries, documents, etc. The illustrated storage flap 130 includes a base 132, a top front pocket 136, a top front pocket cover 134, a bottom front pocket 140, a bottom front pocket cover 138, and a rear pocket (not shown). Various shaped pockets and storage systems may be utilized including VELCRO™ attachments, buttons, pocket drains, etc.

Figure 2:
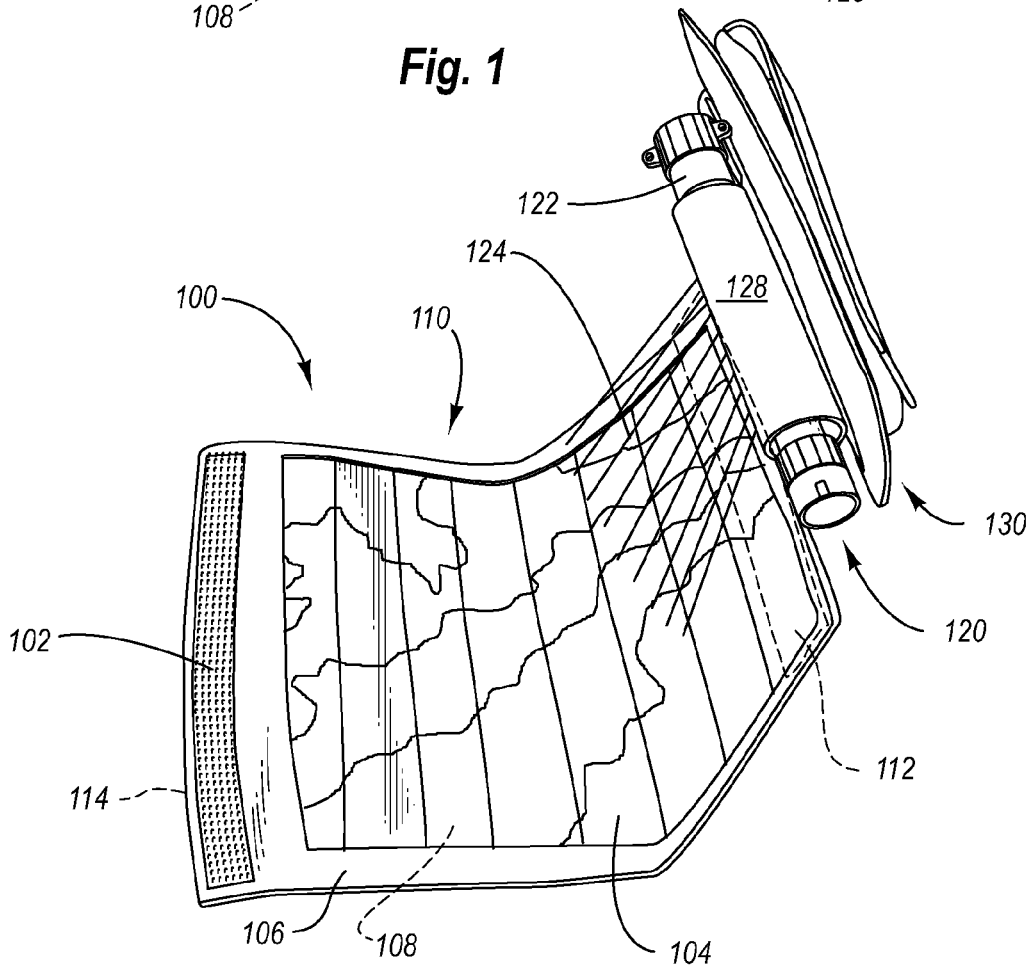
FIG. 2 illustrates a perspective view of the illuminated document case illustrated in FIG. 1, shown in a curved configuration to facilitate directed light transmission on a portion of a housed document.

Reference is next made to FIG. 2, which illustrates a perspective view of the illuminated document case illustrated in FIG. 1 shown in a curved or folded configuration to facilitate directed light transmission on a portion of the housed document. In operation, the illuminated document case 100 may be articulated in various manners to direct the light transmission 124 at the document 108 or a particular portion of the document 108 for detailed inspection. Because the receptacle 120 is flexibly coupled to the sleeve 110, and both the receptacle 120 and sleeve 110 may be composed of substantially flexible material, it is possible to articulate the receptacle 120 in many ways with respect to the document 108. Likewise, the articulation of the receptacle may be utilized to minimize light transmissions 124 away from the document 108 for purposes of concealment.

Figure 3:
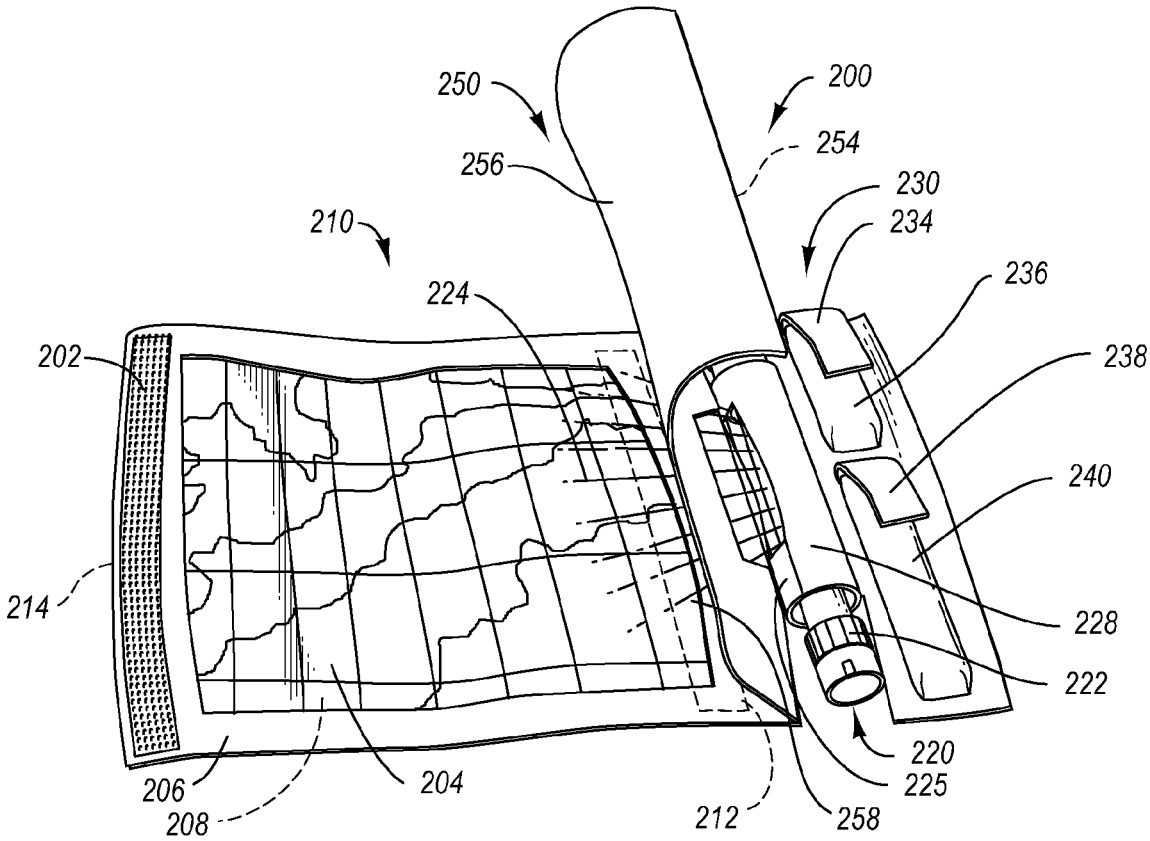
FIG. 3 illustrates a perspective view of an alternative embodiment of a illuminated document case, including a system for housing and illuminating a multi-page document.

Reference is next made to FIG. 3, which illustrates a perspective view of an alternative embodiment of an illuminated document case, including a system for housing and illuminating a multi-page document, designated generally at 200. The illustrated illuminated document case 200 also includes a first sleeve 210, a second sleeve 250, a receptacle 220, and a storage flap 230. The first sleeve 210 further includes a transparent member 204, a housing 206, a first document 208, a pair of releasable coupling members 202 and 212, and a resealable opening 214. The receptacle further includes an illumination device 222, a light transmission 224, a pair of expandable members 225, an illumination opening 226, and support cover 228. The storage flap 230 further includes a base 232, a top front pocket 236, a top front pocket cover 234, a bottom front pocket 240, a bottom front pocket cover 238, and a rear pocket (not shown). The first sleeve 210, receptacle 220, and storage flap 230 and their respective components operate in substantially the same manner as described above with reference to FIG. 1. The second sleeve 250 is flexibly coupled to the first sleeve 210 and the receptacle 220 in a manner that allows light transmission 224 to be selectively directed at either the first sleeve 210, the back/bottom of the second sleeve 250, or the front/top of the second sleeve 250. In the illustrated embodiment, the second sleeve 250 is hinged along the right side of the first sleeve 210 so as to allow the second sleeve 250 to fold out of the way and not obstruct the illumination or viewing of the first sleeve 210. The second sleeve 250 further includes a second transparent member (not shown), a second housing 256, a second document (not shown), an illumination opening 258, and a resealable opening 254. The second transparent member and second housing 256 also allows a document to be protected within the second housing while still preserving view through the second transparent member. In addition, the second sleeve 250 may further allow both the back/bottom and front/top of a document to be viewed. A similar resealable opening 254 is illustrated on the second sleeve 250 as disposed on the end opposite the flexible coupling to the first sleeve 210. The illumination opening 258 is disposed on the side of the second sleeve 250 that is flexibly coupled to the receptacle 220 and first sleeve 210. The illumination opening 258 allows the light transmission 224 from the receptacle to transmit through the second sleeve 250 onto the first sleeve. It should be noted that any number of additional sleeves may be similiarly configured as the second sleeve 250 such that the illuminated display case 200 can be configured to independently illuminate any one sleeve and corresponding document.

Figure 4A:
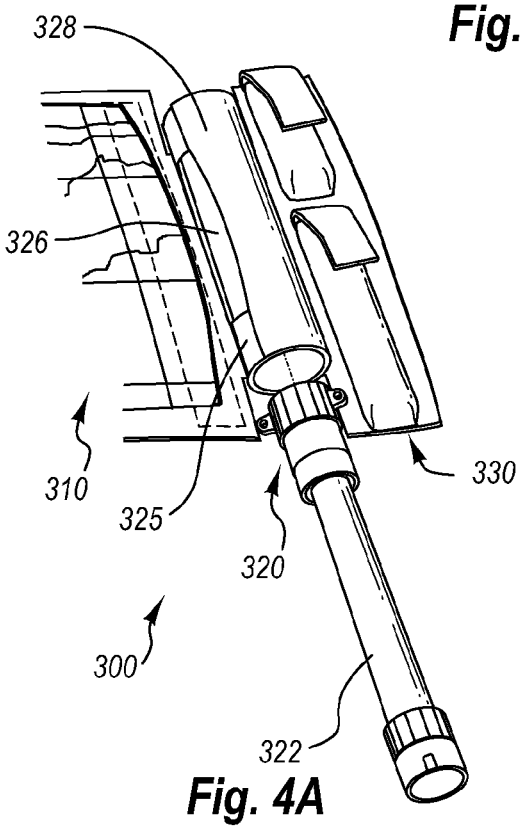
FIGS. 4A and 4B illustrate the insertion of an electrical and a chemical light device into one embodiment of an illuminated document case, respectively.
Figure 4B:
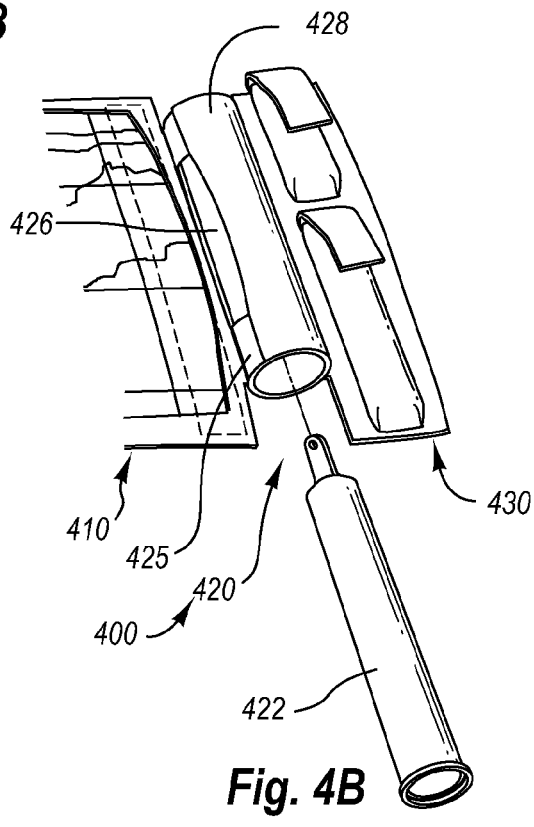

Reference is next made to FIGS. 4A and 4B, which illustrate the insertion of an electrical and a chemical light device into one embodiment of an illuminated document case, respectively. FIG. 4A illustrates a partially exploded illuminated document case 300 including an electrical illumination device 322. The illuminated document case 300 further includes a sleeve 310, a receptacle 320, and a storage flap 330. The sleeve 310 and storage flap 330 operate and are configured in substantially the same manner as described above with reference to FIG. 1. The receptacle 320 further includes the electrical illumination device 322, a pair of expandable members 325, an illumination opening 326, and support cover 328. In operation, the illustrated electrical illumination device 322 is inserted lengthwise into the receptacle 320 by expanding the expandable members 325 and orienting the electrical illumination device 322 such that the illumination region is disposed within the illumination opening 326. The electrical illumination device 322 may then be selectively turned on and off to create light transmission through the illumination opening 326 onto the sleeve 310. Various electrical illumination devices may be utilized in accordance with the present invention including but not limited to a LAZERBRITE2™ device.

Likewise, FIG. 4B illustrates a partially exploded illuminated document case 300 including a chemical illumination device 422. The illuminated document case 400 further includes a sleeve 410, a receptacle 420, and a storage flap 430. The sleeve 410 and storage flap 430 operate and are configured in substantially the same manner as described above with reference to FIG. 1. The receptacle 420 further includes the chemical illumination device 422, a pair of expandable members 425, an illumination opening 426, and support cover 428. In operation, the illustrated chemical illumination device 422 is inserted lengthwise into the receptacle 420 by expanding the expandable members 425 and orienting the chemical illumination device 422 such that the illumination region is disposed within the illumination opening 426. The chemical illumination device 422 may be activated to create light transmission through the illumination opening 426 onto the sleeve 410. Various chemical illumination devices may be utilized in accordance with the present invention including but not limited to a CYALUME™ or KRILL™ device.

Figure 5A:
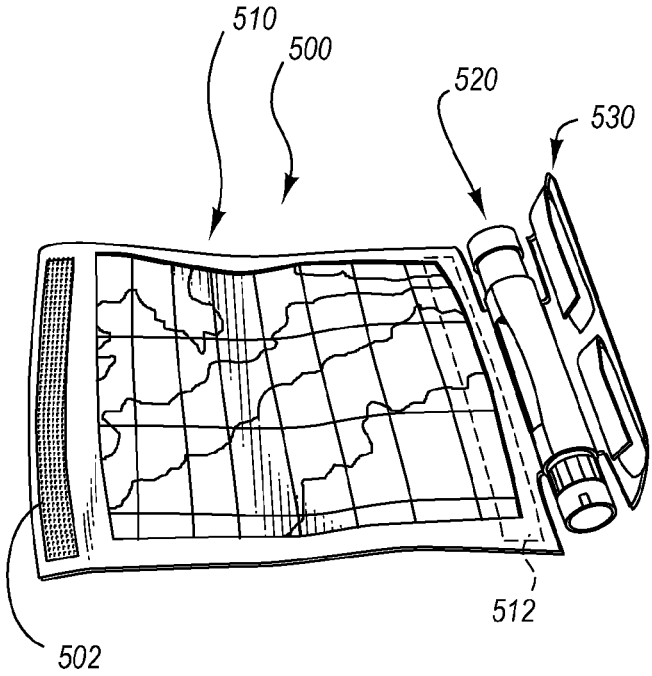
FIGS. 5A-5D illustrate a method for rolling the illuminated document case of FIG. 1 for purposes of storage and/or concealment.
Figure 5B:
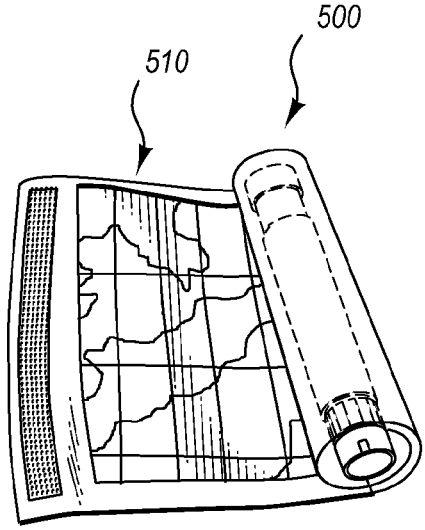
Figure 5C:
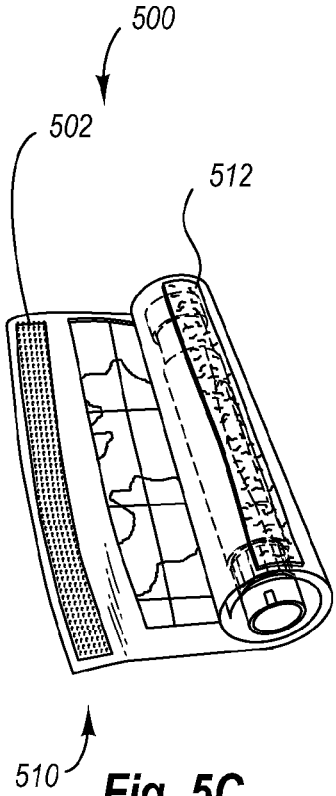
Figure 5D:
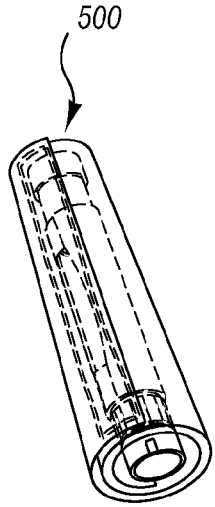

Reference is next made to FIGS. 5A-5D, which illustrate a method for rolling the illuminated document case of FIG. 1 for purposes of storage and/or concealment. The illuminated document case is generally designated at 500 and further includes a sleeve 510, receptacle 520, and a storage flap 530. Additional details regarding the components of the illuminated document case 500 are described above with reference to FIGS. 1-4. The sleeve 510 further includes a pair of releasable coupling members 502 and 512. The illustrated releasable coupling members 502, 512 utilize a VELCRO™ attachment system. However, any other releasable coupling or closure system may be utilized to support the illuminated document case 500 in the most dimensionally contained configuration. FIG. 5A illustrates a substantially unrolled, expanded, or flat configuration in which an illumination device in the receptacle 520 may be utilized to illuminate a document in the sleeve 510. The storage flap 530 is initially rolled a particular amount around the receptacle 520 toward the sleeve 510 to transition to the state illustrated in FIG. 5B. The storage flap 530 and receptacle 520 are then rolled further within the sleeve 510 to transition to the state illustrated in FIG. 5C. Both of releasable coupling members 502, 512 are directly viewable and oriented in substantially the same direction. The sleeve 510 is then rolled up further to join the two releasably coupling members 502, 512 thereby releasably engaging a rolled configuration of the illuminated document case 500 for convenient storage and transportation.

It should also be noted that various sizes and shapes of sleeves, receptacles, and storage flaps may be incorporated into an illuminated document case in accordance with embodiments of the present invention. For example, larger 8"×16" or 16"×16" sleeves may be utilized to accept correspondingly sized single or multi-page documents. Likewise, a larger and/or longer receptacle may be included such that it may house larger or multiple illumination systems for transmitting an increased amount of light onto the document. In addition or alternatively, additional receptacles may be placed on the opposite and/or adjacent sides of the sleeve from the first receptacle to house additional illumination systems that transmit light onto the document from multiple locations. This may be particularly important for illuminating larger documents. For example, two illumination sources may be disposed on adjacent sides of a 16"×16" document to properly illuminate the entire two-dimensional surface of the document. Various other multiple receptacle, sleeve location, and size configurations have been contemplated and are consistent with embodiments of the present invention.

Additional embodiments may further include various modular coupling mechanisms for releasable attachment. For example, a MOLLE™ attachment system is often used by the military to attached various accessories onto a soldiers jacket or pants. Interwoven straps and attachments may be positioned on the illuminated document case to be compatible with this type of system. Likewise, additional strips of VELCRO™, lanyards, carabiners, snaphooks, buttons, and other releasable closure systems may be utilized to attach as an accessory to an existing article of clothing or storage.

Various other embodiments have been contemplated, including combinations in whole or in part of the embodiments described above.

What is claimed is:

1. An illuminated document display system comprising:

a partially transparent sleeve configured to house a document, wherein the partially transparent sleeve is at least partially flexible, and wherein the partially transparent sleeve includes four sides, a front surface, and a rear surface, and wherein the front surface further includes a transparent member; and a receptacle flexibly coupled to a particular side of the partially transparent sleeve, wherein the receptacle is configured to releasably house an illumination device which produces a light output, and wherein the receptacle includes an opening and a cover, wherein the opening enables the light output to transmit substantially toward the front surface via the particular side of the partially transparent sleeve, and wherein the cover blocks light output transmission in radial directions other than toward the front surface via the particular side.

2. The system of claim 1, further including at least one other partially transparent sleeve configured to house additional documents, wherein the at least one other partially transparent sleeve is at least partially flexible, wherein the at least one other partially transparent sleeves are flexibly coupled to the particular side in a manner that does not obstruct the light output from transmitting substantially toward the front surface when the at least one other partially transparent sleeves are folded away from the partially transparent sleeve.

3. The system of claim 1, wherein the partially transparent sleeve encapsulates the document and includes a resealable closure system disposed on the opposite side from the particular side.

4. The system of claim 1, wherein the partially transparent sleeve includes a releasable rolled containment system that allows the partially transparent sleeve to be maintained in a rolled configuration.

5. The system of claim 4, wherein the side opposite the particular side is the second side, and wherein the rolled configuration includes the particular side rolled within the second side.

6. The system of claim 1, wherein the rear surface of the partially transparent sleeve is optically opaque.

7. The system of claim 1, further includes a storage pouch flexibly coupled to an end of the receptacle opposite of the particular side.

8. The system of claim 1, wherein the receptacle is configured to house a multi- directional illumination system.

9. The system of claim 8, wherein the multi-directional illumination system is an electrical illumination system comprising a light emitting diode and a translucent member.

10. The system of claim 8, wherein the multi-directional illumination system is a chemical illumination device.

11. The system of claim 1 further including an attachment device on the rear surface that facilitates releasable attachment.

12. The system of claim 11, wherein the attachment device is MOLLE compatible.

13. An illuminated document display system comprising:

a partially transparent sleeve configured to house a document, wherein the partially transparent sleeve is at least partially flexible, and wherein the partially transparent sleeve includes four sides, a front surface, and a rear surface, and wherein the front surface further includes a transparent member;

a receptacle flexibly coupled to a particular side of the partially transparent sleeve, wherein the receptacle is configured to releasably house an illumination device which produces a light output, and wherein the receptacle includes an opening and a cover, wherein the opening enables the light output to transmit substantially toward the front surface via the particular side of the partially transparent sleeve, and wherein the cover blocks light output transmission in radial directions other than toward the front surface; and at least one other partially transparent sleeve configured to house additional documents, wherein the at least one other partially transparent sleeve is at least partially flexible, wherein the at least one other partially transparent sleeves are flexibly coupled to the particular side in a manner that does not obstruct the light output from transmitting substantially toward the front surface when the at least one other partially transparent sleeves are folded away from the partially transparent sleeve.

14. The system of claim 13, wherein the partially transparent sleeve includes a releseable rolled containment system that allows the partially transparent sleeve to be maintained in a rolled configuration.

15. The system of claim 13, wherein the receptacle is configured to house a multi-directional illumination system.

16. A method for illuminating a document in a manner to receive visual information from the document while minimizing non-document light transmission comprising the acts of:

providing a document housing including a transparent member;

housing a document within the document housing such that the document can be viewed through the transparent member;

coupling an illumination device to the document housing;

directing illumination from the illumination device toward the document, wherein the act of directing the illumination from the illumination device includes bending the document housing; and blocking illumination from the illumination device that is directed in directions other than the document.

17. The method of claim 16, wherein the act of housing a document includes encapsulating the document.

18. The method of claim 16, wherein the act of coupling an illumination device to the document housing includes inserting the illumination device within a receptacle.

19. The method of claim 16, wherein the act of blocking illumination from the illumination device that is directed in directions other than the document includes covering portions of the illumination device that would enable illumination to be directed in directions other than the document.

* * * * *